United States Patent [19]

Lemmen

[11] 4,165,171

[45] Aug. 21, 1979

[54] ELECTROGRAPHIC APPARATUS AND PROCESS

[75] Inventor: Conrardus J. G. Lemmen, Baexem, Netherlands

[73] Assignee: Océ-van der Grinten N.V., Venlo, Netherlands

[21] Appl. No.: 723,766

[22] Filed: Sep. 16, 1976

Related U.S. Application Data

[63] Continuation-in-part of Ser. No. 564,413, Apr. 2, 1975, abandoned.

[30] Foreign Application Priority Data

Apr. 8, 1974 [NL] Netherlands ..... 7404767

[51] Int. Cl.[2] ..... G03G 21/00; B08B 3/12; G03G 15/00

[52] U.S. Cl. ..... 355/15; 15/256.52; 118/652; 134/1; 355/3 TR; 355/14

[58] Field of Search ..... 355/3 R, 3 TR, 14, 15; 15/1.5, 306 A, 256.51, 256.52; 134/1; 118/652

[56] References Cited

U.S. PATENT DOCUMENTS

| | | | |
|---|---|---|---|
| 351,314 | 10/1886 | Delmage | 15/1.5 |
| 3,146,100 | 8/1964 | Kaufman | 134/1 X |
| 3,438,706 | 4/1969 | Tanaka et al. | 355/15 X |
| 3,536,528 | 10/1970 | De Geest | 134/1 |
| 3,659,526 | 5/1972 | Staller | 15/1.5 X |
| 3,668,008 | 6/1972 | Severynse | 134/1 |
| 3,743,540 | 7/1973 | Hudson | 134/1 |
| 3,751,156 | 8/1973 | Szostak et al. | 355/3 R |
| 3,850,519 | 11/1974 | Weikel | 355/3 R |
| 4,075,011 | 2/1978 | Iwasa et al. | 355/3 R X |

FOREIGN PATENT DOCUMENTS 1116077 6/1968 United Kingdom .

*Primary Examiner*—Fred L. Braun
*Attorney, Agent, or Firm*—Albert C. Johnston

[57] ABSTRACT

Powder particles blemishing the background of a powder image formed by attraction of toner particles to an electrostatic charge pattern on a photoconductive support surface are removed selectively without loss of the image by subjecting the image bearing surface to a limited electric field generated from a wall defining a suction mouth through which the powder particles attracted by this field from the support are sucked away. In an embodiment involving transfer of the powder image, the suction mouth serves also as a protective device for removing all powder particles from the support surface if a receiving material is not in position at the transfer station to receive the image, for which purpose a high voltage is applied at the suction mouth and/or the support surface is treated ahead of the suction mouth to diminish its charges attracting the image particles. Further, any powder particles remaining on the support surface after transfer of the image are removed by subjecting the support surface at a location beyond the transfer station to an electric field from a wall defining a second suction mouth through which these particles are sucked away.

47 Claims, 2 Drawing Figures

FIG. 1
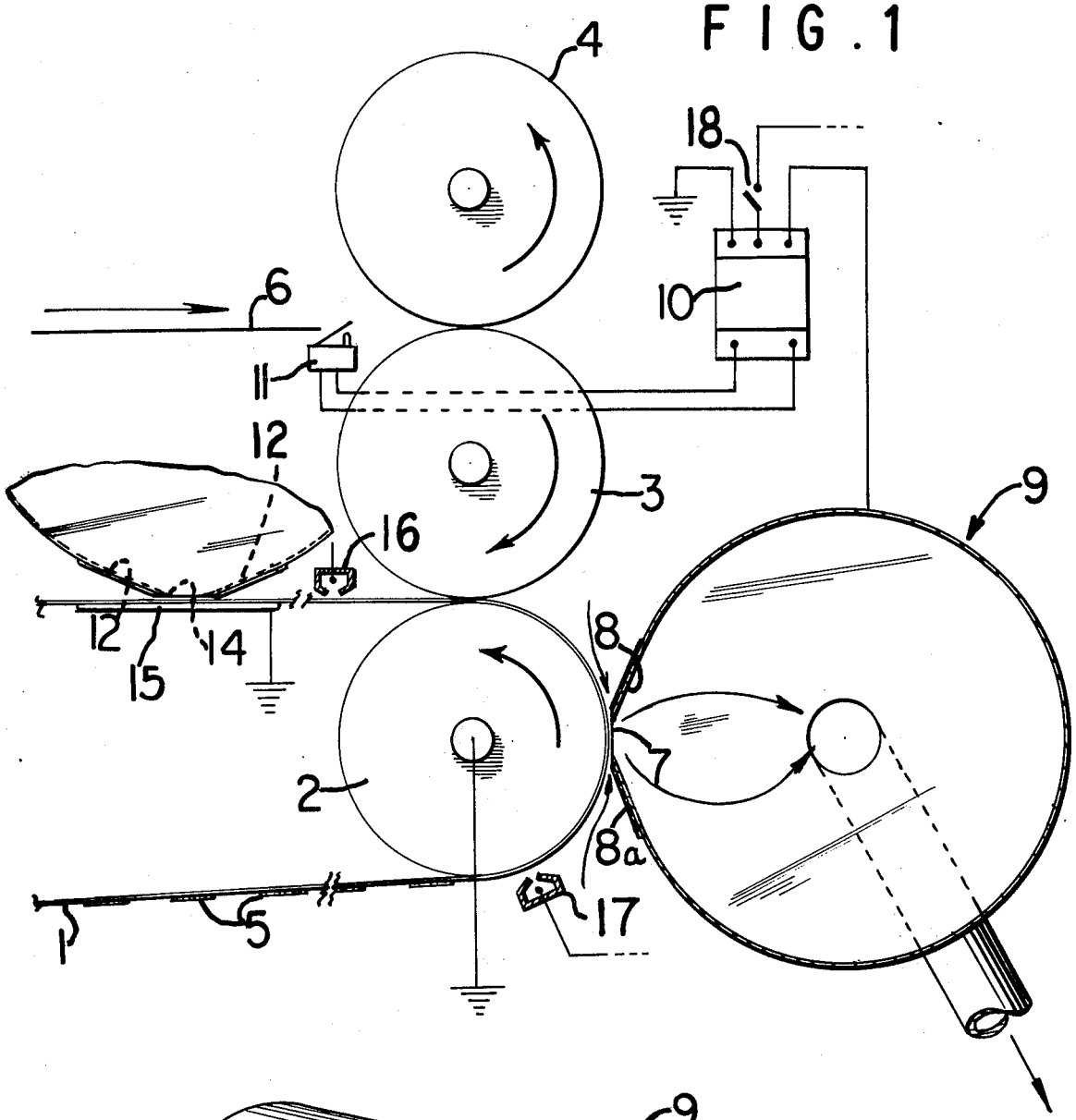
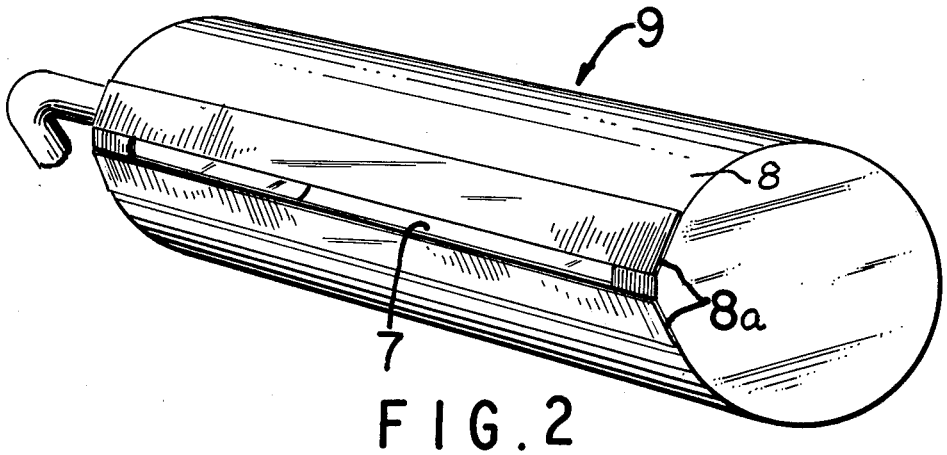
FIG. 2

ELECTROGRAPHIC APPARATUS AND PROCESS

This application is a continuation-in-part of copending U.S. application Ser. No. 564,413, filed Apr. 2, 1975, now abandoned.

This invention relates to an electrographic apparatus and process of the type wherein an electrostatic charge pattern formed on a photoconductive support surface is developed by the attraction of powder particles, or toner, to the image areas of the charge pattern.

An apparatus and process of that type for direct electrophotographic copying are known, for instance, from U.S. Pat. No. 3,870,017, in which a sheet of imagewise exposed photoconductive material has the powder image formed directly on it to constitute the desired copy. According to another known technique, for instance, as disclosed in U.S. Pat. No. 3,926,625, the powder image is formed on an exposed section of a belt of photoconductive material, from which the powder image is transferred to a receiving material to produce a copy by indirect electrophotography.

Upon imagewise exposure of the photoconductive belt or sheet material, its surface having been charged electrostatically, the areas strongly exposed to light are discharged, while the areas corresponding with the image portions of the original remain unexposed so that these areas retain their charge and will attract the toner particles to form the powder image.

The extent to which the photoconductive material discharges at a certain light intensity depends upon the exposure time, discharge becoming more complete as the exposure time is prolonged. The exposure time, however, may not be too long, because in such event the areas of the photoconductive material corresponding with the image areas of the original will also be discharged to a greater or lesser degree and, consequently, will attract fewer or no powder particles. On the other hand, too short an exposure time results in insufficient discharging of areas of the photoconductive material not corresponding with the image areas, so that these areas, in consequence, may also attract powder particles and thus cause the formation of a so-called background adversely affecting the contrast of the copy. In order entirely to preclude the formation of a noticeable background, such a long exposure time would be required that the areas of the photoconductive surface corresponding with the image areas would also be discharged to some extent and, as a result, an overexposed, weak copy would be obtained.

According to known practices, objectionable background often is formed on the photoconductive material not only as a result of insufficient discharging of the non-image areas but also, irrespective of the time of exposure and extent of discharge, as a result of mechanical effects such as forces of adhesion. Therefore, the formation of a background cannot be prevented without making special provisions which themselves objectionably complicate the electrographic apparatus or its operation.

The principal object of the present invention is to provide an apparatus and process by which a background formed on the photoconductive material by powder particles adhering to non-image areas can be largely removed, so that clearer, more contrasty copies may be produced.

Further objects of the invention are to provide such an apparatus and process, for indirect electrophotographic copying, whereby substantially all the powder particles on the photoconductive surface of the imaging medium are removed before the image reaches the transfer station if a receiving material is not in position there to receive the powder image, and/or whereby any powder particles remaining on the support surface after transfer of the powder image are effectively removed.

According to the present invention, after an electrostatic charge pattern has been formed by imagewise exposure and developed into a powder image on a photoconductive support surface, which may be the surface, for example, of a sheet or web in the case of direct electrophotography or of an endless belt in the case of indirect electrophotography, the image bearing support surface is subjected to a voltage applied to it from an electrically conductive wall that defines a suction mouth disposed adjacent and opposite to said surface, this voltage being effective to attract selectively to said wall particles of the developing powder adhering to the background or non-image areas of the support surface, and the powder particles so attracted from said surface are sucked away by a suction applied through the suction mouth.

In an electrographic apparatus embodying the invention, the electrically conductive wall defining the suction mouth may be located adjacent and opposite to a part of the path of movement of the image bearing support surface away from the developing section of the apparatus, with a suitable voltage source connected electrically to said wall and a suction device connected with the suction mouth.

The voltage applied through the wall of the suction mouth is of such magnitude that mainly the background powder particles, i.e., those adhering to non-image arease, are attracted from the support surface, the powder particles forming the image being attracted therefrom, at most, to a considerably lesser degree. The attracted powder particles are sucked off immediately, so that they cannot adhere permanently to the wall of the suction mouth or accumulate thereon.

According to another feature of the invention, the same suction mouth by which background powder particles are attracted and carried away is also used advantageously as a protective device in an apparatus employing a photoconductive medium from which the powder image is to be transferred for reception by a receiving material. This adaptation is particularly useful for apparatus in which the image transfer is effected by an intermediate medium, e.g., a roller surface, that receives the image from the support surface and carries the image to a zone where it is transferred to a receiving material with the aid of heat and/or pressure. In this adaptation, as the powder image approaches the suction mouth the presence or absence of a receiving material in position to receive the image is sensed, such as by a sheet sensing means acting in the path of movement of receiving material to the image transferring means, and, upon the absence of a receiving material in such position being sensed, the voltage applied from the wall of the suction mouth is increased to an intensity effective to attract substantially all the powder particles from the support surface for removal through the suction mouth. In this way, the powder image is entirely removed from the photoconductive medium, and contamination of parts of the apparatus, e.g., the above mentioned intermediate medium, by the image powder is avoided.

In another embodiment for effecting complete removal of the powder image before it reaches the transfer station, the photoconductive support surface bearing the powder image is subjected at a location ahead of the suction mouth, in response to the absence of a receiving material in position to receive the image, to a treatment that reduces the electrostatic attraction between said surface and the powder particles thereon. This treatment may be effected, for example, by a light source or a corona acting on the imaging medium under the control of sensing means responding to the absence of a receiving material in position to receive the image. In this way the voltage at the suction mouth can be kept lower than otherwise required for the removal of all the powder, or it may even be kept constant at the magnitude employed normally for selectively removing background powder particles from the support surface.

According to a further feature of the invention, which is especially useful in the case of transferring the powder image formed on an imaging medium such as a belt of photoconductive material, a second voltage is applied to the photoconductive surface at a location beyond the transfer station, from a second electrically conductive wall which defines a second suction mouth disposed adjacent and opposite to said surface, this voltage being sufficiently great to attract to the second wall any of the powder particles that may remain on said surface, and the powder particles so attracted are sucked away through the second suction mouth. The second suction mouth removes all the powder particles that may have been left on the imaging medium after the powder image has been transferred, so that a medium such as a belt of photoconductive material can be passed onward in clean condition. In this practice, the voltage applied from the wall of the second suction mouth is at least five times greater than that applied from the first suction mouth, or else the support surface is subjected at a location between the image transfer means and the second suction mouth to a treatment for reducing the electrostatic forces of attraction between this surface and the powder particles.

The above mentioned and other objects, features and advantages of the invention will be further apparent from the following description of an illustrative embodiment, in which reference is made to the accompanying drawing.

FIG. 1 of the drawing is a schematic view of an apparatus for carrying out the invention in indirect electrophotographic copying with the use of an endless belt of a photoconductive material as the imaging medium.

FIG. 2 is a perspective view of a suction mouth.

FIG. 1 schematically represents a part of the apparatus that is traversed by a portion 1 of the endless belt of photoconductive material after this belt portion has passed through exposure and developing stations for the formation of an electrostatic charge pattern on its surface and development thereof into a powder image.

The powder image on the belt is schematically represented at 5. The portion or section of the belt carrying this image is passed about a grounded roller 2, against which it is passed by a transfer roller 3 which in turn is engaged by a superimposed pressure roller 4. The powder image is transferred first to the surface of roller 3, which carries it into the nip between rollers 3 and 4 where the image is to be transferred to a receiving material 6, typically a paper sheet. The sheet 6 is positioned and movable so as to pass through the nip of rollers 3 and 4, for receiving the image synchronously with the movement of the image thereto on roller 3 from the moving belt surface.

A wall 8 of electrically conductive material, for instance of aluminum or other conductive metal, defines a suction mouth 7 that opens at a small distance from the surface of the part of belt 1 passing about roller 2. The wall 8 is the peripheral wall of a tubular member having, for instance, a diameter of about 10 cm., which member as shown is closed at one end and has a conduit extending from its other end to a device for sucking air through it, e.g., to a conventional fan, blower, air pump, or vacuum box. The mouth opening 7 preferably has a width of about 2.5 to 3 mm. and extends axially of the tubular member 9 over substantially the entire width of the belt 1 at a distance of from 0.1 to 1 mm., preferably about 0.3 mm., from the photoconductive belt surface. As air is sucked from and through member 9, the suction at the mouth 7 produces quite thin streams of air flowing into the mouth at relatively high velocity in the directions of the arrows (FIG. 1) through the narrow gap between the outer side margins of the mouth and the belt surface. The thin air streams thus sucked into the mouth slit 7 attain a velocity sufficient to entrain and carry with them into the suction mouth particles of the developing powder that either lie loose on the belt surface or are loosened from it by the applied electrical field as described more fully below. The air velocity in these streams amounts, for instance to about 10 to 300 cm. per second.

The conductive wall 8 of the suction mouth 7 is connected electrically to a voltage control unit 10 which is supplied with voltage from a suitable source (not shown). The voltage control unit 10 is connected with a sheet sensing device 11 located near, and acting in the path of movement of, a sheet 6 of receiving material in position to enter the nip between rollers 3 and 4 so that it can receive a powder image 5 being carried toward roller 3 for transfer. The sensing device 11 is, for instance, a microswitch located so that its arm will be moved to close a circuit by a sheet moving toward the nip. Other sheet sensing devices, however, will serve as well, for instance, a light source such as a light emitting diode cooperating with a light sensitive element such as a photocell. When a sheet 6 is present in position to enter the nip for image reception, the device 11 senses the presence of the receiving material and produces a current or signal to the voltage control unit 10, which causes this unit to maintain through its connection to the mouth wall 8 the voltage required for selectively removing background powder particles from the image bearing surface of the belt 1. On the other hand, if a receiving material is not present in such position, the device 11 senses the absence of the receiving material and produces a corresponding circuit condition which causes the voltage control unit 10 to increase the voltage applied through the wall 8 to the strength required for removing all the powder particles from the belt surface through the suction mouth.

At a location beyond the image transfer station, i.e., beyond the transfer rollers 2 and 3, an electrically conductive wall 12 defines a second suction mouth 14 lying adjacent and opposite to the photoconductive belt surface and a grounded backing plate 15. The structure forming this second suction mouth may have the same form as the tubular member 9, and it is also connected with a suction device (not shown) so that it will suck over and away from the surface of the belt 1 a thin stream of air and any powder particles entrained in the air. The second mouth wall 12 is connected electrically to a suitable voltage source (not shown) so that an electric field of between 3 and 30 kV/cm. sufficiently strong to attract all remnant powder particles from the photoconductive surface will be maintained between that surface and wall 12.

The voltage applied to the wall 8 at suction mouth 7 when a sheet 6 is in position to receive an image preferably has the same polarity as the charge pattern on the belt 1, and has an intensity that generates between the belt surface and the wall of mouth 7 an electric field strength of between 3 and 10 kV/cm. Alternatively, this voltage may be a pulsating direct voltage that generates an electric field not exceeding about 70 kV/cm. in strength. A suitable pulsating direct current can be obtained by single phase or double phase rectification and transformation of an a.c. voltage, which can be a normal line voltage at normal frequency of 60 Hz or at a higher frequency of up to 30 kHz. The nominal voltage to be applied for a desired field strength depends of course upon the distance between the wall of the suction mouth and the surface of the photoconductive medium.

In the normal operation of the apparatus, a direct voltage of limited intensity is applied to the wall of the first suction mouth 7, and a direct voltage of the order of ten-fold greater intensity is applied to the wall of the second suction mouth 14. The intensity of the voltage for the first mouth is limited so as to produce at this mouth a field which attracts selectively the background powder particles that may be adhering to non-image areas of the photoconductive support surface, but without attracting to any objectionable extent the powder particles forming parts of the image 5. Such selective attraction of the background particles can be accomplished because of the fact that the electrostatic attraction between the powder particles and the support surface is relatively great in the image areas of the charge pattern, while in the non-image areas relatively little or no electrostatic force holds the particles adhering there.

The powder particles attracted from the support surface by the voltage at suction mouth 7 are immediately sucked away through this mouth, and the belt 1 then carries the image 5, with its non-image areas substantially clear of powder particles, into engagement by roller 3 for transfer of the image to that roller and thence to the receiving material 6 passing over roller 3 under pressure from roller 4. After the image has been transferred, any powder particles that may remain on the belt as the belt moves beyond roller 3 are subjected to the high voltage field from the wall 12 of suction mouth 14, which completely releases remnant powder particles from the belt so that they are carried away by the thin air streams being sucked through mouth 14. Thus, the belt 1 as it passes onward beyond the transfer station is substantially entirely rid of powder particles and in good condition to receive a new powder image in another copying operation.

In the event that no receiving material 6 is fed to a position enabling it to pass between the rollers 3 and 4 for receiving an image to be transferred from the belt 1, the device 11 senses the absence of a receiving material and activates the voltage control unit 10 so as to increase the voltage applied to the wall of the suction mouth 7. The voltage is then increased to an intensity which generates between the support surface and the wall of suction mouth 7 an electric field strong enough to release and cause removal of the entire powder image 5 from the belt 1, thus preventing the rollers 3 and 4 from becoming contaminated. This electric field normally amounts to at least 15 kV/cm. and preferably has a value of between 20 and 30 kV/cm.

In order to avoid arcing between the photoconductive support 1 and portions of the wall 8 or 12 bordering the suction mouth 7 or 14, the surfaces of these bordering wall portions which face the support surface are coated, as indicated at **8*a*** in the drawing, with a semi-conductive material having a resistance of between $10^5$ and $10^{10}$ ohm cm. The coating resistance preferably is approximately $10^7$ ohm cm. A suitable semi-conductive coating material, for instance, is a butadiene-acrylonitrile rubber such as the products known and available commercially as "Butaprene" or "Hycar".

In another embodiment of the invention, the photoconductive surface of the belt 1 is subjected to a treatment for reducing the electrostatic forces of attraction between this surface and the powder particles at a location between the transfer means 3, 4 and the second suction mouth 12. For this purpose, for instance, a light source or an alternating current corona 16 may be arranged to expose the belt surface in known manner to a field of radiation, or an electric field, that will greatly diminish the charges on the support surface. In this way the field strength required for the removal of remanent powder particles can be considerably reduced; so the voltage intensity applied to the wall of the suction mouth 12 can also be considerably lower and, if required, can be of the same order of magnitude as the voltage applied to the wall of the suction mouth 7.

Similarly, such a treatment for reducing the electrostatic attraction between the support surface and the powder particles, as by exposure from a light source or a corona 17, can be applied ahead of the suction mouth 7, being brought into action by a condition or signal of a sheet sensing device 11 when there is no receiving material in position to be fed between the rollers 3 and 4 for receiving an image. In such a case the unit 10 controlling the voltage at the suction mouth 7 may comprise a switch 18 for activating and inactivating the light source or corona 17 ahead of that mouth.

What is claimed is:

1. In an electrographic process wherein an electrostatic charge pattern on a photoconductive support surface of an imaging medium is developed into a powder image thereon by powder particles attracted to image areas of the charge pattern and a background may result from powder particles adhering to non-image areas of said surface, and wherein a powder image moved with said surface to a transfer station is transferred from said surface there to be received on a receiving material, the process for removing powder particles from said surface which comprises:

(1) while moving said surface bearing said powder image in a path toward said transfer station and past an electrically conductive wall having a surface extending over and facing said support surface and disposed near thereto, generating between said surfaces an electric field spanning substantially the width of said support surface and having a strength sufficient to attract selectively toward said wall surface background powder particles on said support surface but insufficient to attract objectionably the powder particles forming said image, and flowing air transversely through said field in a thin stream between said surfaces and then away from said support surface through a suction opening extending along said wall surface, thereby removing such background powder particles and sucking them away through said opening; and (2) as a said image on said support surface approaches said wall, sensing the presence or absence of a receiving material in position to receive the image at said transfer station and upon sensing the absence thereof increasing the electric field between said surfaces to a strength effective to release and attract toward said wall surface for removal in said air stream the powder particles forming said image.

2. A process according to claim 1, said electric field being generated by applying to said wall a direct voltage having the same polarity as said charge pattern, said air stream having adjacent to said suction opening a thickness of about 0.1 to 1 mm and a velocity of between 10 and 300 cm per second.

3. A process according to claim 1, said electric field being generated by applying continuously to said wall a direct voltage having the same polarity as said charge pattern and that produces between said surfaces an electric field of between 3 and 10 kV/cm in strength.

4. A process according to claim 1, said electric field being generated by applying to said wall a pulsating direct voltage that produces between said surfaces an electric field not exceeding 70 kV/cm in strength.

5. A process according to claim 1, said increasing of said electric field being effected by applying to said wall a direct voltage having the same polarity as said charge pattern and that produces between said surfaces an electric field of between 15 and 30 kV/cm in strength.

6. A process according to claim 1 which further comprises upon sensing the absence of a receiving material in position to receive the image, subjecting said support surface at a location ahead of or up to said wall to a treatment that reduces the electrostatic attraction between said image areas and the powder particles thereon.

7. In our electrographic process according to claim 1 while moving said support surface beyond said transfer station past a second electrically conductive wall having a surface extending over and facing said support surface and disposed near thereto, generating between said second wall surface and said support surface a second electric field effective to attract toward said second wall surface powder particles remaining on said support surface beyond said transfer station, said second field spanning substantially the width of said support surface, and flowing air transversely through said second field in a thin stream between said support surface and said second wall surface and then away from said support surface through a second suction opening extending along said second wall surface, thereby removing and sucking away such remaining powder particles.

8. A process according to claim 7, said second electric field having the same polarity as said charge pattern and being at least five times stronger than the first-mentioned electric field.

9. A process according to claim 7, each of said electric fields being generated by applying to the respective electrically conductive wall a direct voltage having the same polarity as said charge pattern, and each of said air streams having at a location adjacent to the respective suction opening a thickness of about 0.1 to 1 mm and a velocity of between 10 and 300 cm per second.

10. A process according to claim 7, and at a location between said transfer station and said second wall surface subjecting said support surface to a treatment that reduces the electrostatic attraction between said support surface and powder particles remaining thereon.

11. A process according to claim 10, said treatment being by an A.C. corona discharge.

12. In an electrographic process wherein an electrostatic charge pattern on a photoconductive support surface of an imaging medium is developed into a powder image thereon by powder particles attracted to image areas of the charge pattern and a background may result from powder particles adhering to non-image area of said surface, and wherein a powder image moved with said surface to a transfer station is transferred from said surface there to be received on a receiving material, the process for removing powder particles from said surface which comprises:

(1) while moving said surface bearing said powder image in a path toward said transfer station and past an electrically conductive wall having a surface extending over and facing said support surface and disposed near thereto, generating between said surfaces an electric field spanning substantially the width of said support surface and having a strength sufficient to attract selectively toward said wall surface background powder particles on said support surface but insufficient to attract objectionably the powder particles forming said image, and flowing air transversely through said field in a thin stream between said surfaces and then away from said support surface through a suction opening extending along said wall surface, thereby removing such background powder particles and sucking them away through said opening; and (2) as a said image on said support surface approaches said wall, sensing the presence or absence of a receiving material in position to receive the image at said transfer station and upon sensing the absence thereof subjecting said support surface at a location ahead of or up to said wall to a treatment that reduces the electrostatic attraction between said image areas and the powder particles thereon so that said electric field will release and attract toward said wall surface for removal in said air stream the powder particles forming said image.

13. A process according to claim 12, said treatment being by an A.C. corona discharge.

14. A process according to claim 12, said electric field being generated by applying to said wall a direct voltage having the same polarity as said charge pattern, said air stream having adjacent to said suction opening a thickness of about 0.1 to 1 mm and a velocity of between 10 and 300 cm per second.

15. A process according to claim 12, said electric field being generated by applying continuously to said wall a direct voltage having the same polarity as said charge pattern and that produces between said surfaces an electric field of between 3 and 10 kv/cm in strength.

16. A process according to claim 12, said electric field being generated by applying to said wall a pulsating direct voltage that produces between said surfaces an electric field not exceeding 70 kv/cm in strength.

17. In an electrographic process according to claim 12, while moving said support surface beyond said transfer station past a second electrically conductive wall having a surface extending over and facing said support surface and disposed near thereto, generating between said second wall surface and said support surface a second electric field effective to attract toward said second wall surface powder particles remaining on said support surface beyond said transfer station, said second field spanning substantially the width of said support surface, and flowing air transversely through said second field in a thin stream between said support surface and said second wall surface and then away from said support surface through a second suction opening extending along said second wall surface, thereby removing and sucking away such remaining powder particles.

18. A process according to claim 17, said second electric field having the same polarity as said charge pattern and being at least five times stronger than the first-mentioned electric field.

19. A process according to claim 17, each of said electric fields being generated by applying to the respective electrically conductive wall a direct voltage having the same polarity as said charge pattern, and each of said air streams having at a location adjacent to the respective suction opening a thickness of about 0.1 to 1 mm and a velocity between 10 and 300 cm per second.

20. A process according to claim 17, and at a location between said transfer station and said second wall surface subjecting said support surface to a treatment that reduces the electrostatic attraction between said support surface and powder particles remaining thereon.

21. A process according to claim 20, said treatment being by an A.C. corona discharge.

22. In an electrographic apparatus whereby an electrostatic charge pattern on a photoconductive support surface is developed into a powder image thereon by powder particles attracted to image areas of the charge pattern and a background may result from powder particles adhering to non-image areas of said surface, means for removing powder particles from said surface, comprising an electrically conductive wall having a surface extending over and facing said support surface and disposed near thereto at a location in a path of movement of said support surface with powder particles thereon, means for generating between said wall surface and said support surface an electric field spanning substantially the width of the support surface and effective to attract powder particles therefrom toward said wall surface, a suction opening extending over said support surface along said wall surface, and means for flowing air transversely through said field in a thin stream between said surfaces and then away from said support surface through said suction opening, whereby at least powder particles that lie loose on said support surface and any powder particles loosened from it by said field are removed and sucked away through said opening;

said wall being the peripheral wall of a tubular member disposed across said path and connected with means for sucking air through said member, said field generating means including means for applying to said wall a direct voltage having a polarity corresponding to that of said charge pattern, and said suction opening being a slot extending through and axially along said peripheral wall over the width of said support surface, said wall surface being surface portions of said peripheral wall bordering said slot;

said wall surface having thereon a semi-conductive coating preventing arcing between said surfaces, said coating having a resistance of between $10^5$ and $10^{10}$ ohm cm.

23. In an electrographic apparatus whereby an electrostatic charge pattern on a photoconductive support surface is developed into a powder image thereon by powder particles attracted to image areas of the charge pattern and a background may result from such powder particles adhering to non-image areas of said surface, and wherein said surface is a surface of an imaging medium moved along a path extending through a transfer station having means thereat for transferring a powder image from said surface to a receiving material, means for removing powder particles from said surface comprising:

(1) an electrically conductive wall having a surface extending over and facing said support surface and disposed near thereto at a location in said path ahead of said transfer station, means for generating between said wall surface and said support surface an electric field spanning substantially the width of the support surface and having a strength sufficient to attract selectively toward said wall surface background powder particles on said support surface but insufficient to attract objectionably the powder particles forming said image, a suction opening extending over said support surface along said wall surface, and means for drawing air through said opening via the space between said surfaces and thus flowing air transversely through said field in a thin stream and then away from said support surface, so that such background particles are loosened selectively from said support surface and sucked away through said opening;

(2) means operative as a said image on said support surface approaches said wall for sensing the presence or absence of a receiving material in position to receive said image at said transfer station and means responsive to said sensing means upon an absence of such receiving material for subjecting said support surface at a location ahead of or up to said wall to a treatment that reduces the electrostatic attraction between said image areas and the powder particles thereon so that said electric field will release and attract toward said wall surface for removal in said air stream the powder particles forming said image.

24. Apparatus according to claim 23, said surface treatment means comprising an A.C. corona.

25. Apparatus according to claim 23, said transferring means including an intermediate medium for receiving and carrying said image from said support surface and transferring the image to a receiving material in a zone away from said support surface, said sensing means acting in the path of movement of receiving material to said zone.

26. Apparatus according to claim 23, said field generating means including means for applying continuously to said wall a direct voltage that produces between said surfaces an electric field of between 3 and 10 kv/cm in strength.

27. Apparatus according to claim 23, said field generating means includng means for applying to said wall a pulsating direct voltage that produces between said surfaces an electric field not exceeding 70 kv/cm in strength.

28. In an electrographic apparatus whereby an electrostatic charge pattern on a photoconductive support surface is developed into a powder image thereon by powder particles attracted to image areas of the charge pattern and a background may result from such powder particles adhering to non-image areas of said surface, and wherein said surface is a surface of an imaging medium moved along a path extending through a transfer station having means thereat for transferring a powder image from said surface to a receiving material, means for removing powder particles from said surface comprising:

(1) an electrically conductive wall having a surface extending over and facing said support surface and disposed near thereto at a location in said path ahead of said transfer station, means for generating between said wall surface and said support surface an electric field spanning substantially the width of the support surface and having a strength sufficient to attract selectively toward said wall surface background powder particles on said support surface but insufficient to attract objectionably the powder particles forming said image, a suction opening extending over said support surface along said wall surface, and means for drawing air through said opening via the space between said surfaces and thus flowing air transversely through said field in a thin stream and then away from said support surface, so that such background particles are loosened selectively from said support surface and sucked away through said opening;

(2) means operative as a said image on said support surface approaches said wall for sensing the presence or absence of a receiving material in position to receive said image at said transfer station, and means responsive to said sensing means upon an absence of such receiving material for increasing the electric field between said surfaces to a strength effective to release and attract toward said wall for removal in said air stream the powder particles forming said image.

29. Apparatus according to claim 28, said wall being the peripheral wall of a tubular member disposed across said path and connected with means for sucking air through said member, said field generating means including means for applying to said wall a direct voltage having a polarity corresponding to that of said charge pattern, and said suction opening being a slot extending through and axially along said peripheral wall over the width of said support surface, said wall surface being surface portions of said peripheral wall bordering said slot.

30. Apparatus according to claim 29, said slot having a width of about 2.5 to 3 mm and being located at a distance of about 0.1 to 1 mm from said support surface, said sucking means being operative to draw air through the space between the margins of said slot and said support surface at a velocity of between 10 and 300 cm per second.

31. Apparatus according to claim 29, said wall surface having thereon a semi-conductive coating preventing arcing between said surfaces.

32. Apparatus according to claim 31, said coating having a resistance of between $10^5$ and $10^{10}$ ohm cm.

33. Apparatus according to claim 32, said coating being of a butadiene-acrylonitrile rubber.

34. Apparatus according to claim 28, said field generating means including means for applying continuously to said wall a direct voltage that produces between said surfaces an electric field of between 3 and 10 kV/cm in strength.

35. Apparatus according to claim 28, said field generating means including means for applying to said wall a pulsating direct voltage that produces between said surfaces an electric field not exceeding 70 kV/cm in strength.

36. Apparatus according to claim 28, said field increasing means including means for applying to said wall a direct voltage having the same polarity as said charge pattern and that produces between said surfaces an electric field of between 15 and 30 kV/cm in strength.

37. Apparatus according to claim 28, said transferring means including an intermediate medium for receiving and carrying said image from said support surface and transferring the image to a receiving material in a zone away from said support surface, said sensing means acting in the path of movement of receiving material to said zone.

38. An apparatus according to claim 28 which further comprises means responsive to said sensing means upon an absence of such receiving material for subjecting said support surface at a location ahead of or up to said wall to a treatment that reduces the electrostatic attraction between said image areas and the powder particles thereon.

39. In an electrographic apparatus according to claim 28, a second electrically conductive wall having a surface extending over and facing said support surface and disposed near thereto at a location beyond said transfer station, means for generating between said second wall surface and said support surface a second electric field spanning substantially the width of said support surface and sufficiently strong to attract toward said second wall surface powder particles remaining on said support surface beyond said transfer station, a second suction opening extending over said support surface along said second wall surface and means for drawing air through said second opening via the space between said second wall surface and said support surface and thus flowing air transversely through said second field in a thin stream and then away from said support surface so that such remaining powder particles are loosened by said second field and sucked away through said second opening.

40. An apparatus according to claim 39, said second electric field having the same polarity as said charge pattern and being at least five times stronger than the first-mentioned electric field.

41. Apparatus according to claim 39, each of said walls being the peripheral wall of a tubular member disposed over the path of said imaging medium and connected with means for sucking air through said member, each of said field generating means including means for applying to the respective wall a direct voltage having a polarity corresponding to that of said charge pattern, each of said suction openings being a slot extending through and axially along the respective peripheral wall over the width of said support surface, and each of said wall surfaces being surface portions of the respective peripheral wall bordering the respective slot.

42. Apparatus according to claim 41, each said slot having a width of about 2.5 to 3 mm and being located at a distance of about 0.1 to 1 mm from said support surface and each said sucking means being operative to draw air through the space between the margins of the respective slot and said support surface at a velocity of between 10 and 300 cm per second.

43. Apparatus according to claim 41, each of said wall surfaces having thereon a semi-conductive coating preventing arcing between the respective wall surface and said support surface.

44. Apparatus according to claim 43, each said coating having a resistance of between $10^5$ and $10^{10}$ ohm cm.

45. Apparatus according to claim 44, each said coating being of a butadiene-acrylonitrile rubber.

46. An apparatus according to claim 39 and further comprising means for subjecting said support surface at a location between said transfer station and said second wall surface to treatment for reducing the electrostatic attraction between said support surface and such powder particles remaining thereon.

47. Apparatus according to claim 46, said surface treatment means comprising an A.C. corona.

* * * * *